US009475285B2

(12) United States Patent
Yoshida et al.

(10) Patent No.: US 9,475,285 B2
(45) Date of Patent: Oct. 25, 2016

(54) LIQUID EJECTING APPARATUS

(71) Applicant: SEIKO EPSON CORPORATION, Tokyo (JP)

(72) Inventors: Hiroshi Yoshida, Shiojiri (JP); Toru Hayashi, Suwa (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/996,671

(22) Filed: Jan. 15, 2016

(65) Prior Publication Data

US 2016/0214378 A1 Jul. 28, 2016

(30) Foreign Application Priority Data

Jan. 27, 2015 (JP) ..... 2015-013018

(51) Int. Cl.
*B41J 2/045* (2006.01)
*B41J 13/00* (2006.01)

(52) U.S. Cl.
CPC ..... *B41J 2/04563* (2013.01); *B41J 2/04553* (2013.01); *B41J 2/04586* (2013.01); *B41J 13/0081* (2013.01)

(58) Field of Classification Search
CPC ..... B41J 2/04553; B41J 2/04563; B41J 2/04586; B41J 13/0081
See application file for complete search history.

(56) References Cited

U.S. PATENT DOCUMENTS

2005/0270359 A1* 12/2005 Katsuma ..... B41J 2/365 347/185
2011/0249053 A1* 10/2011 Makita ..... B41J 2/04516 347/17
2013/0265359 A1* 10/2013 Sugaya ..... B41J 11/002 347/16

FOREIGN PATENT DOCUMENTS

JP 2004-050546 2/2004
JP 2012-045855 3/2012

* cited by examiner

*Primary Examiner* — Jason Uhlenhake
(74) *Attorney, Agent, or Firm* — Workman Nydegger

(57) ABSTRACT

A liquid ejecting apparatus includes an ejecting unit which can reciprocate with respect to a continuous paper, and ejects ink onto the continuous paper; a heating unit which heats a liquid ejecting region which is a region in which the ejecting unit can eject the ink to the continuous paper; an IR sensor which detects a temperature of the liquid ejecting region based on infrared light in the liquid ejecting region; and a control device which controls the heating unit based on a first detection temperature of the IR sensor. The control device controls the heating unit without using the first detection temperature which is detected by the IR sensor, when the ejecting unit is located in a temperature detecting region of the IR sensor.

6 Claims, 7 Drawing Sheets

LIQUID EJECTING APPARATUS

BACKGROUND

1. Technical Field

The present invention relates to a liquid ejecting apparatus including a heating unit which heats a medium.

2. Related Art

In the related art, as a type of a liquid ejecting apparatus, an ink jet printer which ejects liquid such as ink from an ejecting unit onto a medium such as continuous paper which is transported on a support member, and causes the liquid to be attached onto the medium, and then prints an image, or the like, on the medium by heating the liquid using a heating unit, and drying the liquid has been known. In addition, as such a printer, there is a printer which includes a temperature detection unit which detects temperature in a liquid ejecting region as a region in which liquid can be ejected from an ejecting unit to a medium, and a heating unit which radiates infrared light, and in which the heating unit is controlled based on a temperature of a medium which is detected using the temperature detecting unit. In addition, in the printer, the temperature detecting unit and the heating unit are arranged at the upper part of a liquid ejecting head of the ejecting unit, and a position which overlaps the ejecting unit in a transport direction in which a medium is transported (For example, refer to JP-A-2012-45855).

Meanwhile, when the ejecting unit is located in a temperature detection region which is a region in which the temperature detecting unit detects the temperature at a timing at which the temperature detecting unit detects a temperature, the temperature detecting unit detects the temperature of the ejecting unit, instead of the temperature in a liquid ejecting region in a medium. In addition, since the heating unit is controlled based on the temperature of the ejecting unit, there is a concern that the accuracy of the control of the heating unit may deteriorate.

SUMMARY

An advantage of some aspects of the invention is to provide a liquid ejecting apparatus which can suppress deterioration in accuracy in controlling of a heating unit.

Hereinafter, means of the invention, and operational effects thereof will be described.

According to an aspect of the invention, there is provided a liquid ejecting apparatus which includes an ejecting unit which can reciprocate with respect to a medium, and ejects liquid onto the medium; a heating unit which heats a liquid ejecting region which is a region in which the ejecting unit can eject the liquid to the medium; a temperature detecting unit which detects the temperature of the liquid ejecting region based on infrared light in the liquid ejecting region; and a control unit which controls the heating unit based on a detection temperature of the temperature detecting unit, in which the control unit controls the heating unit without using the detection temperature which is detected by the temperature detecting unit, when the ejecting unit is located in a temperature detecting region of the temperature detecting unit.

According to the configuration, even when the temperature detecting unit detects the temperature of the ejecting unit, instead of the temperature in the liquid ejecting region in a medium, since control of the heating unit is not performed using the temperature, it is possible to prevent the heating unit from being controlled based on an incorrect temperature. Accordingly, it is possible to suppress deterioration in accuracy in controlling of the heating unit.

In the liquid ejecting apparatus, it is preferable that the control unit controls the heating unit without using a detection temperature which is detected by the temperature detecting unit when the ejecting unit is located in a temperature ineffective region which is a region larger than the temperature detecting region, including the entire region of the temperature detecting region in a movement direction of the ejecting unit.

Also in a case in which the ejecting unit is located in the vicinity of the temperature detecting region, there is a case in which a detection temperature of the temperature detecting unit is influenced by a temperature of the ejecting unit. In this point, according to the configuration, since a detection temperature which is detected by the temperature detecting unit is not used when the ejecting unit is located in the temperature ineffective region which is larger than the temperature detecting region in the movement direction of the ejecting unit, a detection temperature with a risk that the ejecting unit may have an influence on the detection temperature of the temperature detecting unit is not used. Accordingly, it is possible to further suppress deterioration in accuracy of the heating unit.

In the liquid ejecting apparatus, it is preferable that the temperature detecting region is located at the center of the temperature ineffective region in the movement direction of the ejecting unit.

According to the configuration, in an outward movement and a return movement of the ejecting unit, since a range in which a detection temperature with a risk that the ejecting unit may have an influence on detecting of a temperature of the temperature detecting unit is not used is the same, the degree of suppressing deterioration in accuracy in controlling of the heating unit is the same in the outward movement and the return movement of the ejecting unit.

In the liquid ejecting apparatus, it is preferable that the control unit controls the heating unit based on a detection temperature which is detected by the temperature detecting unit immediately before entering the temperature ineffective region of the ejecting unit.

According to the configuration, since the heating unit is controlled using a temperature which most accurately reflects a temperature change due to the heating unit in the liquid ejecting region in the medium as a detection temperature, instead of a detection temperature on which the ejecting unit has an influence in detecting of a temperature of the temperature detecting unit, it is possible to further suppress deterioration in accuracy in controlling of the heating unit.

In the liquid ejecting apparatus, it is preferable that the control unit controls the heating unit based on a detection temperature which is detected by the temperature detecting unit immediately before entering the temperature detecting region of the ejecting unit.

According to the configuration, since the heating unit is controlled using a temperature which reflects a temperature change due to the heating unit in the liquid ejecting region in the medium as a detection temperature, instead of a detection temperature with a risk that the ejecting unit may have an influence on detecting of a temperature of the temperature detecting unit, it is possible to further suppress deterioration in accuracy in controlling of the heating unit.

In the liquid ejecting apparatus, it is preferable that the heating unit heats the liquid ejecting region using infrared light, the ejecting unit is located on the medium side rather than the heating unit and the temperature detecting unit, and a portion of the ejecting unit which faces the heating unit is covered with a cover which reflects the infrared light.

According to the configuration, it is possible to suppress a temperature rise in the ejecting unit by preventing infrared light of the ejecting unit from entering inside the ejecting unit due to the cover. However, since infrared light that the heating unit irradiates is reflected by the cover, there is a case in which the temperature detecting unit detects the temperature of the heating unit, or a temperature which is close to the temperature when the ejecting unit is located in the temperature detecting region. In this point, as described above, since a detection temperature of the temperature detecting unit is not used when the ejecting unit is located in the temperature detecting region, deterioration in the accuracy in controlling of the heating unit is suppressed. Accordingly, it is possible to suppress both a temperature rise in the ejecting unit and deterioration in accuracy in controlling of the heating unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment of a liquid ejecting apparatus will be described with reference to drawings. In addition, the liquid ejecting apparatus according to the embodiment is configured as an ink jet printer which performs printing by ejecting ink as an example of liquid to a medium, for example. In addition, a printing type of the printer is a so-called serial type in which printing is performed by moving an ejecting unit in a main scanning direction which is a direction intersecting a transport direction of a medium, and an example of a movement direction of the ejecting unit.

Figure 1:
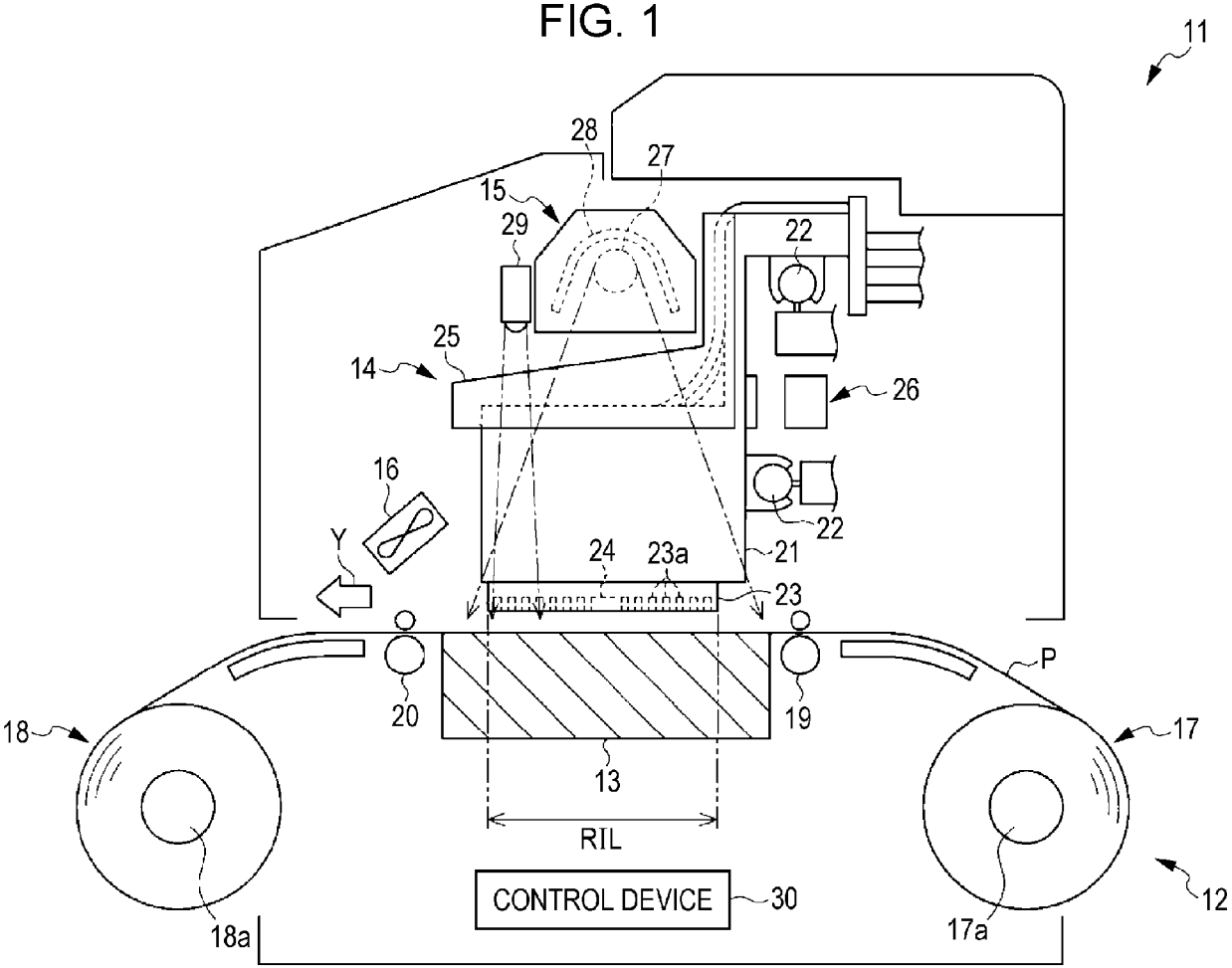
FIG. 1 is a schematic configuration diagram of a liquid ejecting apparatus according to one embodiment.

As illustrated in FIG. 1, a liquid ejecting apparatus 11 includes a transport unit 12 which transports long sheet-shaped continuous paper P as an example of a medium, an ejecting unit 14 which ejects ink onto the continuous paper P which is transported on a support member 13 using the transport unit 12, and performs printing, and a heating unit 15 which heats a liquid ejecting region RIL which is a region in which the ejecting unit 14 can eject ink on the continuous paper P. In addition, the liquid ejecting apparatus 11 includes an air blowing unit 16 for making a temperature of the continuous paper P which is located in the liquid ejecting region RIL uniform. In addition, the liquid ejecting region RIL is a region in which the ejecting unit 14 can eject ink onto the continuous paper P in a range in which the ejecting unit 14 moves in a main scanning direction X (direction orthogonal to paper surface in FIG. 1) which is a width direction of the continuous paper P.

The transport unit 12 includes a feeding unit 17 which sends out the continuous paper P, and a winding unit 18 which winds up the continuous paper P which is sent out from the feeding unit 17, and on which printing is performed using the ejecting unit 14. In FIG. 1, the feeding unit 17 is arranged at a position on the right side which is the upstream side of the ejecting unit 14 in a transport direction Y (left direction in FIG. 1) in the continuous paper P, and meanwhile, the winding unit 18 is arranged at a position on the left side which is the downstream side of the ejecting unit 14.

A feeding shaft 17*a* which extends in the main scanning direction X is provided in the feeding unit 17 so as to be rotatably driven. The continuous paper P is supported by the feeding shaft 17*a* so as to integrally rotate with the feeding shaft 17*a* in a state of being wound in a roll shape in advance. In addition, the continuous paper P is fed toward the downstream side of a transport path thereof from the feeding shaft 17*a* when the feeding shaft 17*a* is rotatably driven. A pair of sheet feeding rollers 19 which guides the continuous paper P which is transported from the feeding shaft 17*a* to the support member 13 by being rotatably driven while interposing the continuous paper P therebetween is provided on the downstream side of the feeding shaft 17*a* in the transport path.

A pair of discharging rollers 20 which guides a printed region in the continuous paper P to the downstream side from the support member 13 by being rotatably driven while interposing the continuous paper P therebetween is provided on the downstream side of the ejecting unit 14 in the transport path.

In the winding unit 18 which is arranged on the downstream side of the pair of discharging rollers 20 in the transport path, a winding shaft 18*a* which extends in the main scanning direction X is provided so as to be rotatably driven. In addition, the printed continuous paper P which is transported from the pair of discharging rollers 20 is sequentially wound using the winding shaft 18*a* when the winding shaft 18*a* is rotatably driven.

The ejecting unit 14 includes a box-shaped carriage 21 which is supported so as to reciprocate in the main scanning direction X with respect to the continuous paper P using a pair of support shafts 22 which extends in the main scanning direction X. A liquid ejecting head 23 in which a plurality of nozzles 23*a* are formed on a face which faces the continuous paper P is mounted on the carriage 21. A nozzle plate thermistor 24 which detects the temperature of the face which faces the continuous paper P, that is, a temperature of the plurality of nozzles 23*a* is attached to the liquid ejecting head 23. The nozzle plate thermistor 24 is configured of a thermo-electric element. In addition, a cover 25 in an L shape which is formed of, for example, aluminum or an aluminum alloy is attached to a side opposite to the continuous paper P (upper side) in the carriage 21. The ejecting unit 14 with such a configuration ejects ink toward the continuous paper P from the plurality of nozzles 23*a* while moving in the main scanning direction X with respect to the continuous paper P.

A linear encoder 26 which detects a position of the ejecting unit 14 in the main scanning direction X is provided at a position on the upstream side of the carriage 21 in the transport path, and between the pair of support shafts 22. The linear encoder 26 includes a light emitting element and a light receiving element which are attached to the carriage 21, and a slit which faces the light emitting element and the light receiving element with an interval in the transport direction Y.

The heating unit 15 is arranged at a position on the upper side of a part of the cover 25, and a position which overlaps the cover 25 in the transport direction Y. That is, the heating unit 15 is arranged so as to face the cover 25. In other words, a portion in the ejecting unit 14 which faces the heating unit 15 is covered with the cover 25. The heating unit 15 includes a heater 27 which heats the continuous paper P which is located in the liquid ejecting region RIL by radiating infrared light. A reflecting plate 28 which reflects the infrared light which is radiated by the heater 27 toward the continuous paper P is arranged on the upper side of the heater 27.

Figure 2:
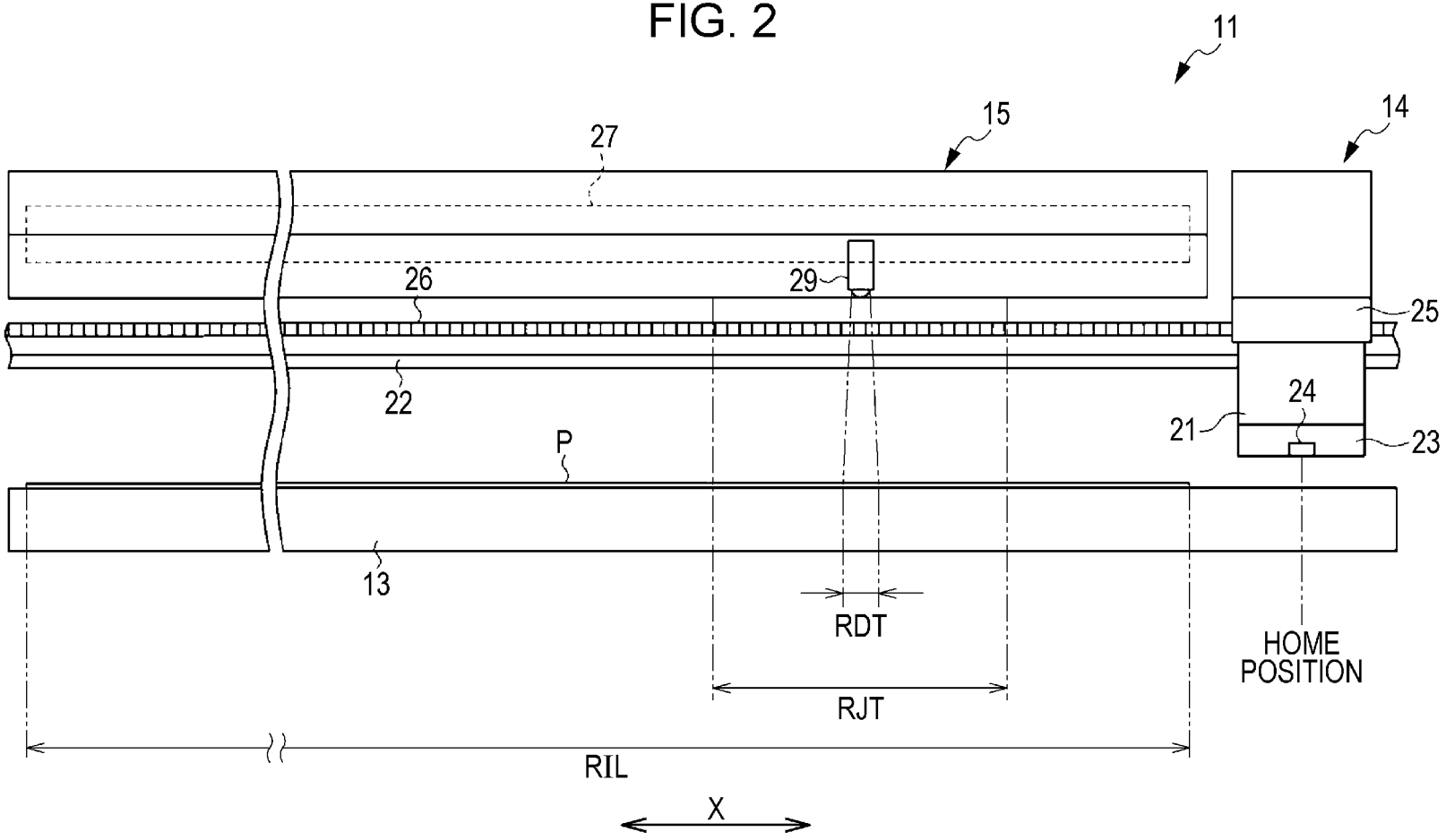
FIG. 2 is a schematic configuration diagram of the liquid ejecting apparatus in FIG. 1 which illustrates a front structure.

In addition, an infrared (IR) sensor 29 as an example of the temperature detecting unit which detects the temperature of the continuous paper P which is located in the liquid ejecting region RIL is provided on the downstream side of the transport path, and a home position side in the main scanning direction X (refer to FIG. 2) in the heating unit 15. The IR sensor 29 is a radiation thermometer which detects the temperature of the continuous paper P which is located in the liquid ejecting region RIL, by detecting the quantity of infrared light in a temperature detecting region RDT (refer to FIG. 2) in the liquid ejecting region RIL in a non-contact manner using a built-in infrared light sensor (not illustrated). The IR sensor 29 is arranged so as to confront the liquid ejecting region RIL on the upstream side of the continuous paper P which is located in the liquid ejecting region RIL. In addition, the temperature detecting region RDT is determined by a specification of the IR sensor 29. In addition, the home position is a non-printing region on the right side of the continuous paper P as illustrated in FIG. 2. In the home position, a maintenance mechanism (not illustrated) which performs maintenance such as cleaning with respect to the liquid ejecting head 23 is provided.

Figure 3:
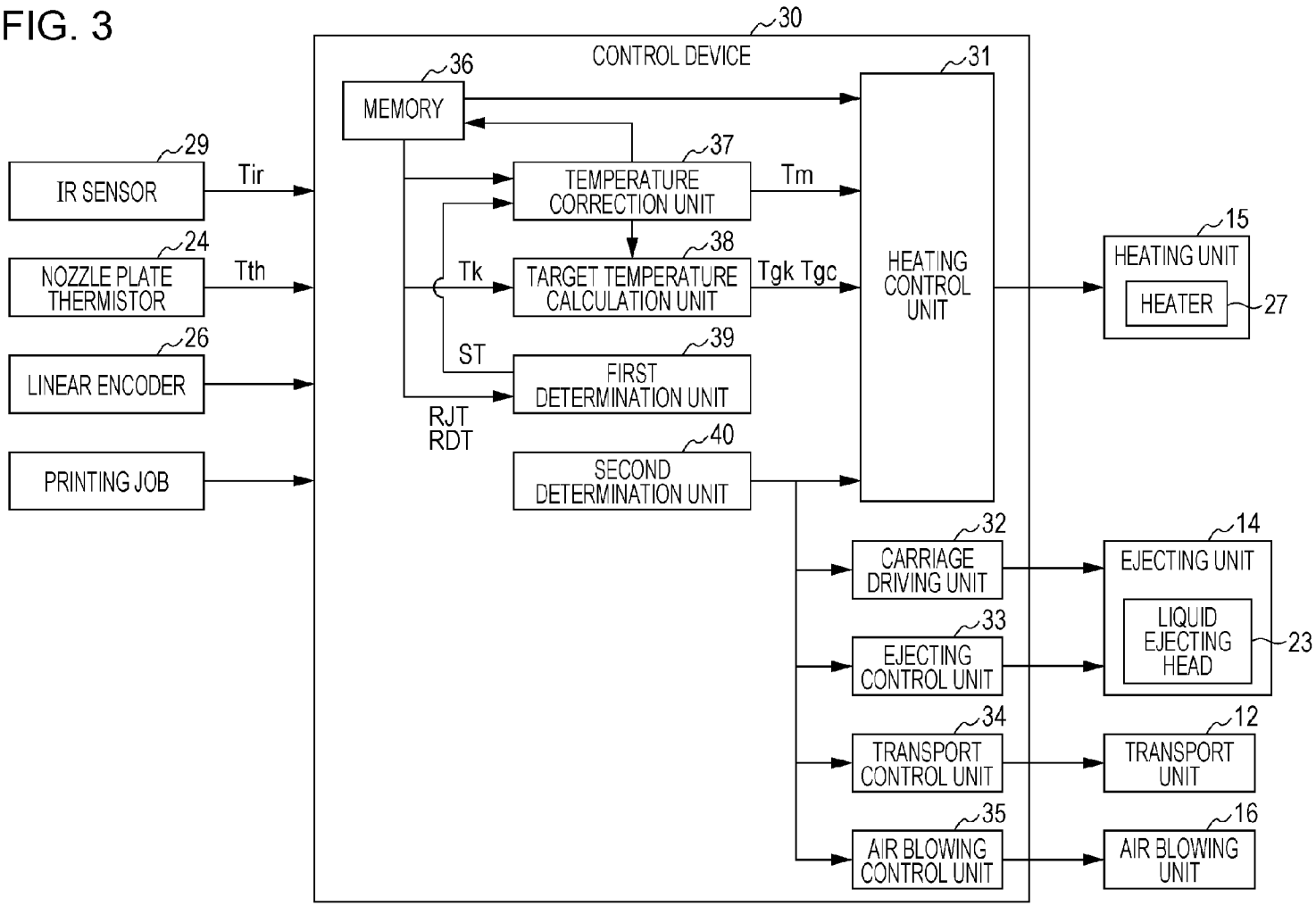
FIG. 3 is a block diagram which illustrates an electrical configuration of the liquid ejecting apparatus.

In addition, as illustrated in FIG. 1, the liquid ejecting apparatus 11 includes a control device 30 as an example of a control unit which controls operations of the transport unit 12, the ejecting unit 14, the heating unit 15, and the air blowing unit 16. As illustrated in FIG. 3, in the control device 30, a first detection temperature Tir which is a temperature of the continuous paper P located in the liquid ejecting region RIL which is detected by the IR sensor 29, and is a detection temperature of the temperature detecting unit, and a second detection temperature Tth which is a temperature of the plurality of nozzles 23*a* (refer to FIG. 1) which is detected by the nozzle plate thermistor 24, are input. In addition, a position signal which is a position of the ejecting unit 14 in the main scanning direction X which is detected by the linear encoder 26, and a printing job are input to the control device 30. The printing job includes a size of the continuous paper P, data such as an image to be printed on the continuous paper P, and a printing command for executing printing.

The control device 30 includes a heating control unit 31 which performs a PWM control with respect to an output of the heater 27, and a carriage driving unit 32 which controls a movement of the carriage 21 (refer to FIG. 1) in the main scanning direction X based on the printing job. In addition, the control device 30 includes an ejecting control unit 33 which controls ejecting of ink to the liquid ejecting region RIL using the liquid ejecting head 23 based on a printing job, a transport control unit 34 which controls transporting of the continuous paper P using the transport unit 12 based on a printing job, and an air blowing control unit 35 which controls the air blowing unit 16 based on a temperature of the continuous paper P which is located in the liquid ejecting region RIL.

A memory 36, a temperature correction unit 37, a target temperature calculation unit 38, and a second determination unit 40 are connected to the heating control unit 31. The first detection temperature Tir of the IR sensor 29, the second detection temperature Tth of the nozzle plate thermistor 24, and arithmetic expressions which are used in the temperature correction unit 37 and the target temperature calculation unit 38, or a threshold value, are stored in the memory 36. A first determination unit 39 is connected to the temperature correction unit 37. The temperature correction unit 37 corrects a detection temperature of the IR sensor 29 in consideration of the influence of the quantity of infrared light, which is input to the IR sensor 29, of the heater 27 which is reflected from the continuous paper P, from the first detection temperature Tir of the IR sensor 29. The first determination unit 39 determines whether or not the ejecting unit 14 enters a range which has an influence on detection of a temperature of the IR sensor 29. The target temperature calculation unit 38 calculates a target temperature of the continuous paper P which is located in the liquid ejecting region RIL based on the second detection temperature Tth of the nozzle plate thermistor 24. The second determination unit 40 determines whether or not printing on the continuous paper P is finished. The heating control unit 31 performs a feedback control so that a temperature of the continuous paper P which is located in the liquid ejecting region RIL matches a target temperature of the continuous paper P which is located in the liquid ejecting region RIL, based on signals which are input from the memory 36, the temperature correction unit 37, the target temperature calculation unit 38, and the second determination unit 40. According to the embodiment, as the feedback control, Proportional-Integral-Derivative (PID) control is performed.

The air blowing control unit 35 drives the air blowing unit 16 when a temperature of the continuous paper P which is located in the liquid ejecting region RIL approximately reaches the target temperature of the continuous paper P which is located in the liquid ejecting region RIL. In this manner, a temperature of the continuous paper P which is located in the liquid ejecting region RIL becomes uniform.

Figure 4:
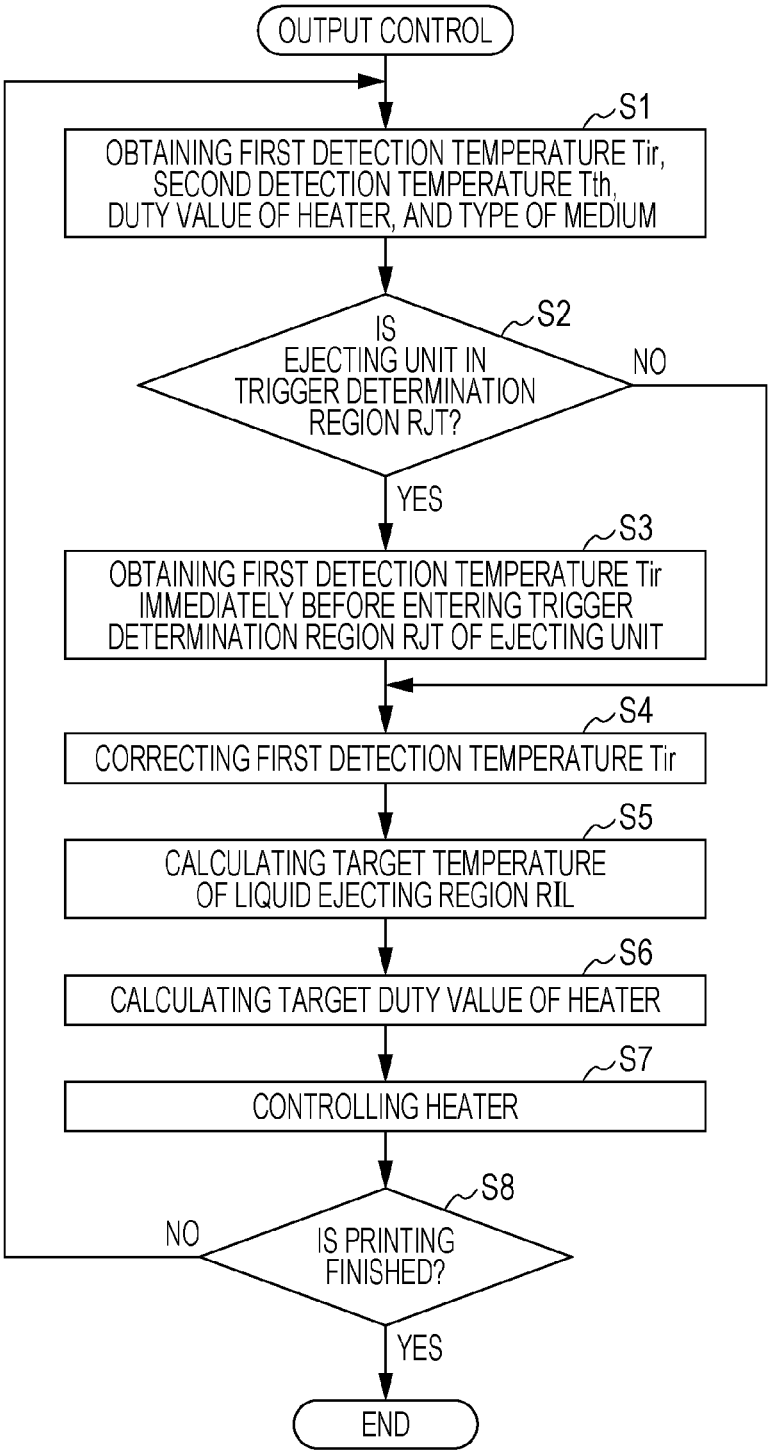
FIG. 4 is a flowchart which illustrates a procedure of an output control which is executed using the liquid ejecting apparatus.

The control device 30 performs an output control in which an output of the heater 27 is controlled based on the temperature of the continuous paper P which is located in the liquid ejecting region RIL, and the temperature of the plurality of nozzles 23*a*, based on the above described configuration. Hereinafter, a processing procedure of the output control will be described using the flowchart in FIG. 4.

First, the control device 30 obtains the first detection temperature Tir, the second detection temperature Tth, an ON DUTY value (hereinafter, simply referred to as DUTY value) which is an output of the heater 27, and a type of medium (step S1). In addition, a type of the medium is obtained when a user inputs a type of the medium to be used in printing to the liquid ejecting apparatus 11 from a host computer or an operation unit of the liquid ejecting apparatus 11 (both are not illustrated).

Subsequently, the control device 30 determines whether or not the ejecting unit 14 enters the range which has an influence on detecting of a temperature of the IR sensor 29 using the first determination unit 39 (step S2). Detailed contents of the determination will be described using FIGS. 1 to 5F.

The cover 25 of the ejecting unit 14 reflects infrared light of the heater 27 since the cover is made of metal such as aluminum. For this reason, the IR sensor 29 which is provided in the vicinity of the heater 27 detects temperature based on infrared light of the heater 27 which is reflected by the cover 25, when the ejecting unit 14 enters the temperature detecting region RDT which is a region in which the IR sensor 29 detects the temperature of the continuous paper P which is located in the liquid ejecting region RIL. That is, the first detection temperature Tir of the IR sensor 29 becomes approximately the same as a temperature of the heater 27. Accordingly, the IR sensor 29 erroneously detects the temperature of the continuous paper P which is located in the liquid ejecting region RIL as a temperature of the heater 27.

In addition, when the ejecting unit 14 is located in the vicinity of the temperature detecting region RDT without entering the temperature detecting region RDT of the IR sensor 29, there is a concern that infrared light of the heater 27 which is reflected by the cover 25 may have an influence on detection of a temperature of the IR sensor 29.

Therefore, in the control device 30, as a range in which the ejecting unit 14 has an influence on detecting of a temperature of the IR sensor 29, the temperature detecting region RDT in the main scanning direction X is included, and a trigger determination region RJT (refer to FIG. 2) which is the temperature ineffective region larger than the temperature detecting region RDT is stored in the memory 36. As illustrated in FIG. 2, the trigger determination region RJT is a region which is formed by being extended to both sides in the main scanning direction X from a center position of the temperature detecting region RDT in the main scanning direction X, by a dimension of the ejecting unit 14 in the main scanning direction X. For this reason, the temperature detecting region RDT is located at a center of the trigger determination region RJT in the main scanning direction X.

In addition, the first determination unit 39 outputs a trigger signal ST to the temperature correction unit 37 when at least a part of the ejecting unit 14 enters the trigger determination region RJT. The first determination unit 39 continuously outputs the trigger signal ST to the temperature correction unit 37 over a period of time in which at least a part of the ejecting unit 14 is located in the trigger determination region RJT. In addition, determination on whether or not at least a part of the ejecting unit 14 enters the trigger determination region RJT is made based on a position signal of the linear encoder 26.

Figures 5A, 5B, 5C, 5D, 5E, 5F:
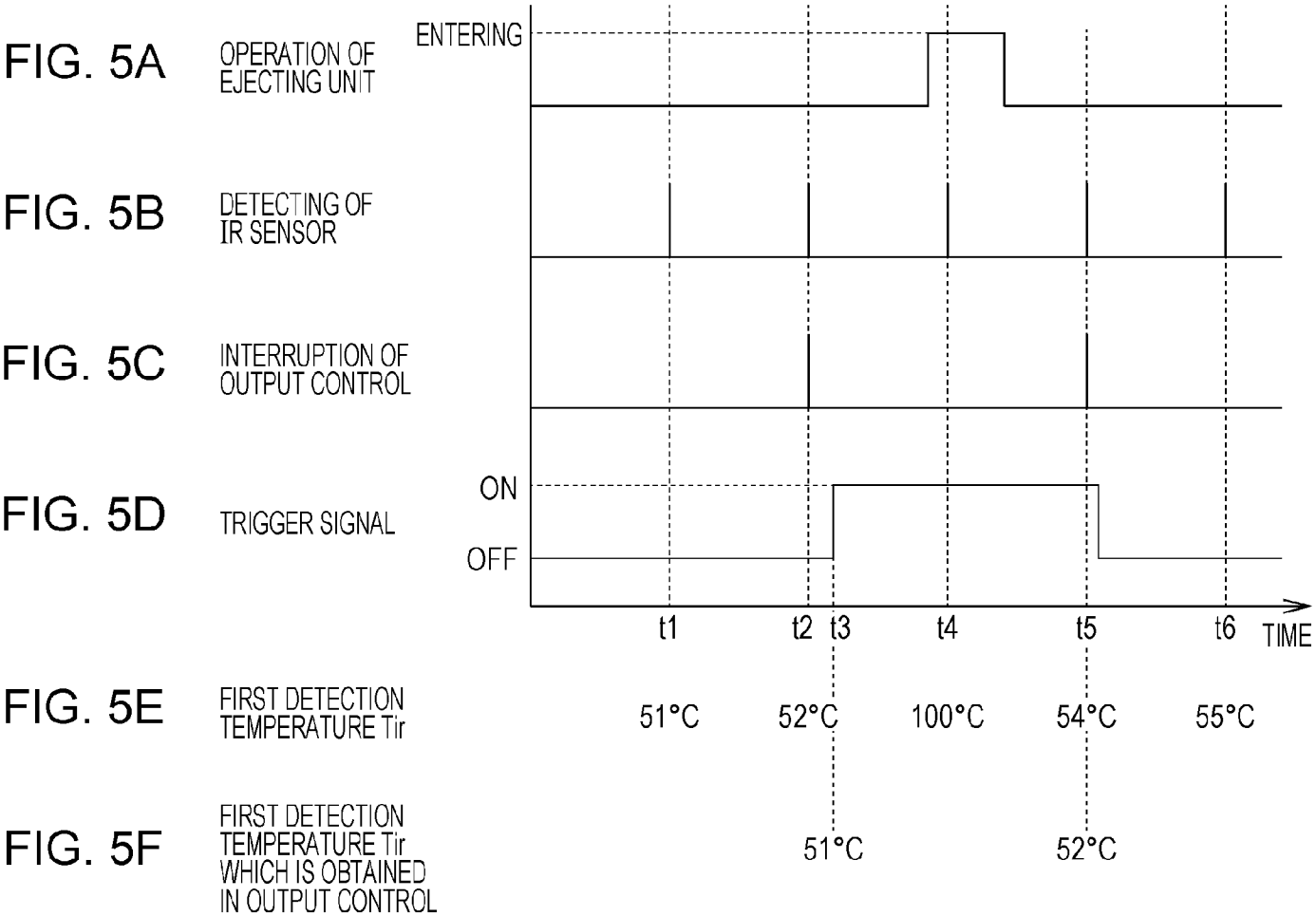
FIGS. 5A to 5F are time charts which denote one execution mode of a part of an output control.

For example, FIGS. 5A to 5F illustrate operations of the ejecting unit 14 and the IR sensor 29, an interruption of an output control, and a transition of the trigger signal ST, when the IR sensor 29 detects the first detection temperature Tir in every predetermined detecting cycle, and an output control is performed in every cycle which is longer than the detecting cycle of the first detection temperature Tir. In addition, FIGS. 5A to 5F illustrate a state in which a temperature of the continuous paper P which is located in the liquid ejecting region RIL is rising. For this reason, as illustrated in FIG. 5E, the first detection temperature Tir is rising by lapse of time. In addition, in the operation of the ejecting unit 14 in FIG. 5A, a period of time in which the ejecting unit 14 enters the temperature detecting region RDT is denoted by "entering".

As illustrated in FIGS. 5A to 5F, since at least a part of the ejecting unit 14 does not enter the trigger determination region RJT at a time t2 in which an output control is performed (trigger signal ST in FIG. 5D is OFF), the control device 30 obtains the first detection temperature Tir (51° C.) which is detected by the IR sensor 29 at a time t1. That is, the control device 30 obtains the first detection temperature Tir which is detected by the IR sensor 29 at the previous detection timing, when the output control is performed.

Meanwhile, when the ejecting unit 14 enters the trigger determination region RJT at a time t3, as illustrated in FIG. 5D, the first determination unit 39 outputs the trigger signal ST. In addition, at a time t4 which is a detection timing of the IR sensor 29 in the state in which the ejecting unit 14 enters the temperature detecting region RDT, the IR sensor 29 detects the temperature of the heater 27 (100° C.) as the first detection temperature Tir, since infrared light of the heater 27 which is reflected by the cover 25 enters the IR sensor 29.

Therefore, when the trigger signal ST is input to the temperature correction unit 37 (Yes in step S2), the control device 30 obtains the first detection temperature Tir immediately before entering the trigger determination region RJT of the ejecting unit 14, instead of the first detection temperature Tir which is obtained in step S1 (step S3). That is, in an output control which is performed at a time t5 in FIGS. 5A to 5F, the first detection temperature Tir which is detected by the IR sensor 29 at the time t4 is not obtained, and the first detection temperature Tir (52° C.) which is detected at the time t2 which is the detection timing of the IR sensor 29 immediately before entering the trigger determination region RJT of the ejecting unit 14 is obtained.

Meanwhile, when the trigger signal ST is not input to the temperature correction unit 37 (No in step S2), the control device 30 maintains the first detection temperature Tir which is detected at the previous detection timing by the IR sensor 29, that is, the first detection temperature Tir which is obtained in step S1, and then proceeds to step S4.

Subsequently, the control device 30 corrects the first detection temperature Tir based on the first detection temperature Tir which is obtained in step S1 or step S3 by the temperature correction unit 37, the DUTY value of the heater 27 which is obtained in step S1, and a type of medium (step S4).

Detailed contents of correcting of the first detection temperature Tir will be described using FIGS. 3 and 6.

In a design stage of the liquid ejecting apparatus 11, when correcting the first detection temperature Tir, a relationship between a detection error of the IR sensor 29 based on an attaching angle of the IR sensor 29, that is, an angle of the IR sensor 29 with respect to the continuous paper P, a type of medium, and the ability of the heater 27 (wattage) and a heating value DUTY value Hc of the heater 27 is obtained through examination, or the like. The attaching angle of the IR sensor 29, and the ability of the heater 27 are uniquely determined in the design stage of the liquid ejecting apparatus 11. For this reason, a relationship between a detection error of the IR sensor 29 in each type of medium and the heating value DUTY value Hc of the heater 27 is stored in the memory 36 in advance. In addition, the heating value DUTY value Hc of the heater 27 is obtained by multiplying the wattage by the DUTY value of the heater 27.

Figure 6:
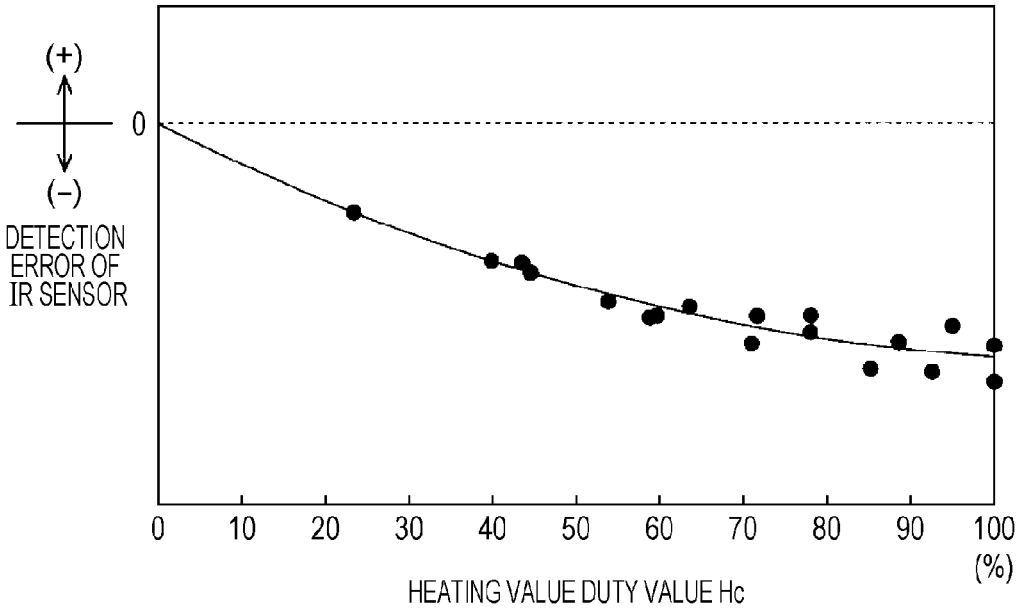
FIG. 6 is a graph which denotes a relationship between a heating DUTY value of a heating unit and a detection error of a temperature detecting unit.

FIG. 6 illustrates the relationship between a detection error of the IR sensor 29 and the heating value DUTY value Hc of the heater 27 when an attaching angle of the IR sensor 29 with respect to the continuous paper P is 90° C., that is, the IR sensor 29 faces the continuous paper P (refer to FIGS. 1 and 2), the heater 27 has predetermined wattage, and plain paper is used as a medium. In addition, since the first detection temperature Tir of the IR sensor 29 is detected as a temperature which is higher than the actual temperature of the continuous paper P which is located in the liquid ejecting region RIL, a detection error of the IR sensor 29 is obtained by subtracting the first detection temperature Tir of the IR sensor 29 from the actual temperature of the continuous paper P located in the liquid ejecting region RIL which is separately detected.

In addition, it is possible to create an approximate curve of a relationship between the detection error of the IR sensor 29 and the heating value DUTY value Hc of the heater 27 from a plurality of plotted values in FIG. 6. In addition, as denoted by the approximate curve in FIG. 6, an absolute value of the detection error of the IR sensor 29 becomes large along with an increase of the heating value DUTY value Hc of the heater 27. A quadratic approximate expression which denotes the approximate curve in FIG. 6 is calculated using the following expression (1) by setting the absolute value of the detection error of the IR sensor 29 as a correction value Tc. The correction value Tc becomes large along with an increase of the heating value DUTY value Hc of the heater 27.

$$Tc=z1\times Hc^2+z2\times Hc+z3 \quad (1)$$

In addition, "z1", "z2", and "z3" denote coefficients which are determined due to the reflectivity of infrared light of the continuous paper P. The coefficients "z1" to "z3" are set in each type of medium, and are stored in the memory 36. For example, values of the coefficients "z1" to "z3" in a case of glossy paper are larger than values of the coefficients "z1" to "z3" in a case of plain paper.

The temperature correction unit 37 calculates a correction value Tc by substituting the heating value DUTY value Hc of the heater 27 for the expression (1). In addition, the temperature correction unit 37 obtains the actual temperature of the continuous paper P which is located in the liquid ejecting region RIL by subtracting a temperature of an absolute value of a detection error of the IR sensor 29 from the first detection temperature Tir of the IR sensor 29. That is, the temperature correction unit 37 calculates a correction temperature Tm which is obtained by correcting the first detection temperature Tir of the IR sensor 29 based on the following expression (2). In addition, the temperature correction unit 37 outputs the correction temperature Tm to the memory 36, the target temperature calculation unit 38, and the heating control unit 31.

$$Tm=Tir-Tc \quad (2)$$

Subsequently, the control device 30 calculates a target temperature of the continuous paper P which is located in the liquid ejecting region RIL using the target temperature calculation unit 38 based on the second detection temperature Tth which is a detection temperature of the plurality of nozzles 23*a* (step S5).

Here, detailed calculation contents of a target temperature of the continuous paper P which is located in the liquid ejecting region RIL will be described.

The target temperature of the continuous paper P which is located in the liquid ejecting region RIL includes a reference target temperature Tgk which is stored in the memory 36 in advance. The reference target temperature Tgk is a temperature which is suitable for drying ink ejected to the continuous paper P which is located in the liquid ejecting region RIL. Meanwhile, since the plurality of nozzles 23*a* are close to the continuous paper P which is located in the liquid ejecting region RIL, the nozzles are easily influenced by a temperature of the continuous paper P which is located in the liquid ejecting region RIL. For this reason, the target temperature calculation unit 38 calculates a target temperature of the continuous paper P which is located in the liquid ejecting region RIL so as to suppress a temperature rise of the plurality of nozzles 23*a* based on the temperature of the continuous paper P which is located in the liquid ejecting region RIL, and the temperature of the plurality of nozzles 23*a*. A specific procedure thereof is as follows.

First, the target temperature calculation unit 38 calculates the difference between the second detection temperature Tth and a temperature threshold value Tk (Tth−Tk), and integrates the difference in each detecting cycle of the nozzle plate thermistor 24. In this manner, the target temperature calculation unit 38 obtains an integrated value Di of the difference between the second detection temperature Tth and the temperature threshold value Tk. In addition, the temperature threshold value Tk is a temperature with a risk of an occurrence of deterioration in performance of the plurality of nozzles 23*a* such as clogging of ink of the plurality of nozzles 23*a*, is preset through examination, or the like, and is stored in the memory 36. The temperature threshold value Tk is lower than the reference target temperature Tgk. In addition, the integrated value Di is reset when an output of the heater 27 becomes "0". In addition, the length of a detection cycle of the nozzle plate thermistor 24 is the same as that of the detection cycle of the IR sensor 29, for example.

In addition, the target temperature calculation unit 38 obtains a correction value d from the following expression (3) based on the integrated value Di. In addition, "G" in expression (3) is a constant which determines the degree to which the reference target temperature Tgk is decreased, is preset through examination, or the like, and is stored in the memory 36.

$$Td=Di\times G \quad (3)$$

Finally, the target temperature calculation unit 38 calculates a correction target temperature Tgc by subtracting a correction value Td from the reference target temperature Tgk as in the following expression (4).

$$Tgc=Tgk-Td \quad (4)$$

As denoted in expression (3), since the correction value Td is proportional to the integrated value Di, the second detection temperature Tth is higher than the temperature threshold value Tk, that is, the integrated value Di is a positive value, and the correction value Td increases along with an increase of the integrated value Di. For this reason, when the correction target temperature Tgc decreases along with an increase of the correction value Td, from expression (4), the correction target temperature Tgc decreases along with an increase of the integrated value Di.

Meanwhile, when the second detection temperature Tth is lower than the temperature threshold value Tk, there is a case in which the difference between the second detection temperature Tth and the temperature threshold value Tk becomes a negative value, and the integrated value Di becomes a negative value. In this manner, when it is assumed that the correction target temperature Tgc is calculated based on the above described expressions (3) and (4), the correction target temperature Tgc becomes higher than the reference target temperature Tgk. In addition, when the second detection temperature Tth is lower than the temperature threshold value Tk, the performance of the plurality of nozzles 23*a* does not decrease, even when the reference target temperature Tgk is not changed.

Therefore, the target temperature calculation unit 38 sets the integrated value Di to "0" when the integrated value Di is a negative value. In this manner, since the correction value Td becomes "0" in the expression (3), the correction target temperature Tgc matches the reference target temperature Tgk.

In addition, when the integrated value Di increases, the degree to which the correction target temperature Tgc becomes lower than the reference target temperature Tgk increases. That is, when excessively putting priority on suppression of deterioration in performance of the plurality of nozzles 23*a*, there is a concern that ink which is ejected to the continuous paper P which is located in the liquid ejecting region RIL may not be easily dried.

Therefore, the target temperature calculation unit 38 sets an integrated upper limit value Dlim to the integrated value Di as the upper limit value thereof, and when the integrated value Di is the integrated upper limit value Dlim or more, the target temperature calculation unit calculates a correction value Td by substituting the integrated upper limit value Dlim for the integrated value Di in the expression (3). In addition, the integrated upper limit value Dlim is stored in the memory 36. In this manner, it is possible to prevent the correction target temperature Tgc from being excessively low with respect to the reference target temperature Tgk.

In addition, when a temperature of the continuous paper P which is located in the liquid ejecting region RIL is sufficiently lower than the reference target temperature Tgk, there is a low possibility that heat of the continuous paper P which is located in the liquid ejecting region RIL raises the temperature of the plurality of nozzles 23*a* to a temperature at which the performance of the nozzle 23*a* decreases. Meanwhile, when the temperature of the continuous paper P which is located in the liquid ejecting region RIL is a temperature which matches the reference target temperature Tgk, or is close thereto, there is a high possibility that heat of the continuous paper P which is located in the liquid ejecting region RIL raises the temperature of the plurality of nozzles 23*a* to a temperature at which the performance of the nozzle 23*a* decreases.

Therefore, when the correction temperature Tm is the correction target temperature Tgc or less, the target temperature calculation unit 38 calculates a target temperature of the continuous paper P which is located in the liquid ejecting region RIL as the reference target temperature Tgk, and calculates a target temperature of the continuous paper P which is located in the liquid ejecting region RIL as the correction target temperature Tgc, when the correction temperature Tm is higher than the correction target temperature Tgc.

As described above, when the temperature of the plurality of nozzles 23*a* and the temperature of the continuous paper P which is located in the liquid ejecting region RIL are low, the target temperature calculation unit 38 calculates a target temperature of the continuous paper P which is located in the liquid ejecting region RIL as the reference target temperature Tgk. Meanwhile, when the temperature of the plurality of nozzles 23*a* is sufficiently high, and the temperature of the continuous paper P which is located in the liquid ejecting region RIL is close to the reference target temperature Tgk, the target temperature calculation unit 38 calculates a target temperature of the continuous paper P which is located in the liquid ejecting region RIL as the correction target temperature Tgc which is lower than the reference target temperature Tgk.

Subsequently, the control device 30 calculates a target DUTY value which is an ON DUTY value as a target of the heater 27, based on the correction temperature Tm, and a target temperature of the continuous paper P which is located in the liquid ejecting region RIL using the heating control unit 31 (step S6). The target DUTY value becomes large along with an increase in the difference between the correction temperature Tm and a target temperature of the continuous paper P which is located in the liquid ejecting region RIL. In addition, the control device 30 controls the heater 27 so that the DUTY value matches the target DUTY value (step S7).

Subsequently, the control device 30 determines whether or not printing on the continuous paper P is finished based on a printing job using the second determination unit 40 (step S8). When it is determined that printing on the continuous paper P is finished (Yes in step S8), the control device 30 finishes the output control. When printing on the continuous paper P is finished, the control device 30 executes processes for finishing printing on the continuous paper P using the ejecting control unit 33, the carriage driving unit 32, and the transport control unit 34. Meanwhile, the control device 30 proceeds to step S1 when it is determined that printing on the continuous paper P is not finished (No in step S8).

One execution mode of the output control will be described using the flowchart in FIGS. 7A to 7C. In addition, a one-dot chain line in FIG. 7B denotes the transition of a target temperature of the continuous paper P which is located in the liquid ejecting region RIL.

Figure 7A:
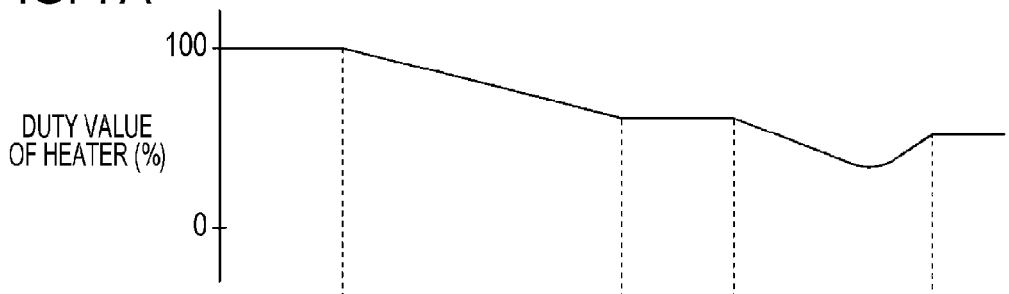
FIGS. 7A to 7C are time charts which denote one execution mode of a part of an output control.
Figure 7B:
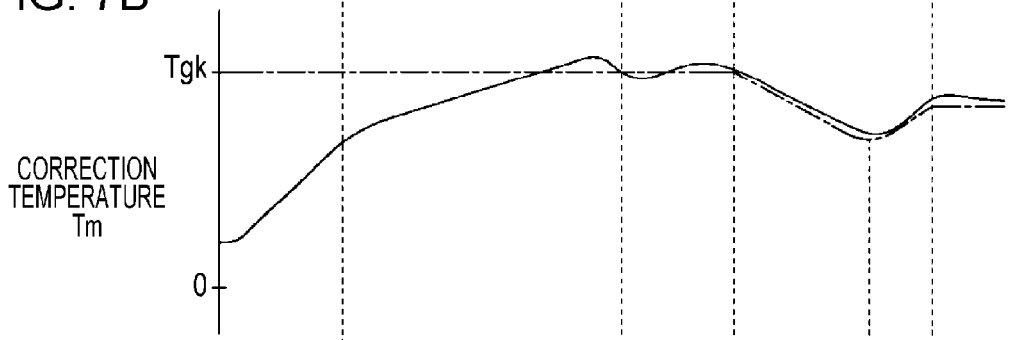
Figure 7C:
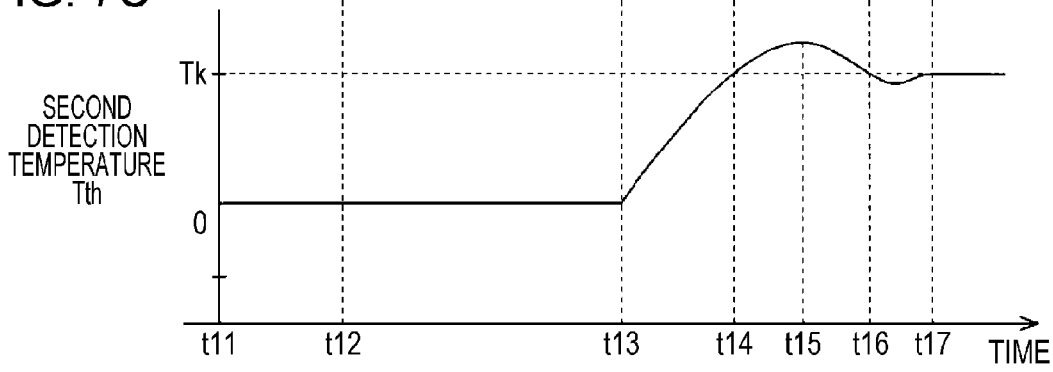

First, at a time t11 in FIGS. 7A to 7C, heating of the continuous paper P which is located in the liquid ejecting region RIL using the heater 27 is started. At this time, as illustrated in FIG. 7A, a DUTY value of the heater 27 is "100%". That is, the heater 27 heats the continuous paper P which is located in the liquid ejecting region RIL with a maximum output. In this manner, as illustrated in FIG. 7B, a temperature of the continuous paper P which is located in the liquid ejecting region RIL rises by lapse of time. In addition, when the correction temperature Tm which is a temperature of the continuous paper P which is located in the liquid ejecting region RIL is approximately close to the reference target temperature Tgk which is a target temperature of the continuous paper P which is located in the liquid ejecting region RIL (time t12), the DUTY value of the heater 27 decreases from "100%". For this reason, after the time t12, the degree to which the correction temperature Tm rises becomes small.

Subsequently, at a time t13 which is illustrated in FIG. 7C, printing on the continuous paper P is started. Along with this, since the ejecting unit 14 is located in a region which the heater 27 heats from the home position, the second detection temperature Tth which is a temperature of the plurality of nozzles 23*a* of the ejecting unit 14 rises due to the heat of the continuous paper P which is located in the liquid ejecting region RIL, and the heat of the heater 27. In addition, as illustrated in FIGS. 7B and 7C, when the second detection temperature Tth becomes larger than the temperature threshold value Tk at a time t14, and the correction temperature Tm is also close to the reference target temperature Tgk, a target temperature of the continuous paper P which is located in the liquid ejecting region RIL is changed from the reference target temperature Tgk to the correction target temperature Tgc. In addition, since the second detection temperature Tth becomes higher than the temperature threshold value Tk in a period from the time t14 to a time t16, the correction target temperature Tgc decreases by lapse of time in the period from the time t14 to the time t16. For this reason, the correction temperature Tm decreases by lapse of time in the period from the time t14 to the time t16. In this manner, since heat of the continuous paper P which is located in the liquid ejecting region RIL has a small influence on the plurality of nozzles 23*a*, as illustrated in FIG. 7C, a degree of temperature rise of the second detection temperature Tth becomes small from the time t14 by lapse of time, and the second detection temperature Tth starts to decrease at a time t15.

Meanwhile, since the second detection temperature Tth is lower than the temperature threshold value Tk in a period from the time t16 to a time t17, the correction target temperature Tgc rises by lapse of time in the period from the time t16 to the time t17. In this manner, since the heat of the continuous paper P which is located in the liquid ejecting region RIL has a large influence on the plurality of nozzles 23*a*, as illustrated in FIG. 7C, the second detection temperature Tth rises from the time t16 by lapse of time.

In this manner, according to the output control, it is possible to suppress deterioration in the performance of the plurality of nozzles 23*a* while maintaining a temperature of the continuous paper P which is located in the liquid ejecting region RIL which is necessary for drying ink ejected to the continuous paper P using the ejecting unit 14.

In the liquid ejecting apparatus 11 according to the embodiment, it is possible to obtain the following effects.

(1) The liquid ejecting apparatus 11 corrects the first detection temperature Tir of the IR sensor 29 based on the heating value DUTY value Hc of the heater 27, and sets a DUTY value of the heater 27 based on the correction temperature Tm as the first detection temperature Tir which is corrected. For this reason, the correction temperature Tm becomes a temperature at which a detection error of the IR sensor 29 which occurs when infrared light of the heater 27 is reflected on the continuous paper P, and enters the IR sensor 29, is taken into consideration. For this reason, the correction temperature Tm becomes a temperature which is closer to the actual temperature of the continuous paper P which is located in the liquid ejecting region RIL. Accordingly, it is possible to control the heater 27 based on a temperature which is closer to the actual temperature of the continuous paper P which is located in the liquid ejecting region RIL.

(2) The liquid ejecting apparatus 11 obtains a correction value Tc corresponding to the heating value DUTY value Hc of the heater 27, and obtains the correction temperature Tm by subtracting the correction value Tc from the first detection temperature Tir. For this reason, it is possible to set the correction temperature Tm to be close to the actual temperature of the continuous paper P which is located in the liquid ejecting region RIL with respect to the entire output range of the heater 27 compared to a case in which it is assumed that the correction value Tc is a constant.

(3) For example, as illustrated in FIG. 6, there is a case in which a detection error of the IR sensor 29 increases along with an increase of the heating value DUTY value Hc of the heater 27. Even in such a case, since the correction value Tc is set to be large along with the increase of the heating value DUTY value Hc of the heater 27, it is possible to set the correction temperature Tm to be closer to the actual temperature of the continuous paper P which is located in the liquid ejecting region RIL.

(4) Since the reflectivity of infrared light which is irradiated from the heater 27 is different depending on a type of medium, there is a case in which the first detection temperature Tir becomes different depending on a type of medium, even when the heater 27 has the same heating value DUTY value Hc. In this point, according to the embodiment, since the coefficients z1 to z3 in the expression (1) are changed according to a type of medium, the correction value Tc becomes different according to a type of medium. For this reason, it is possible to obtain an appropriate correction value Tc with respect to a type of medium, and to set the correction temperature Tm to be close to the actual temperature of a medium which is located in the liquid ejecting region RIL.

(5) The IR sensor 29 is arranged so as to confront the continuous paper P. For this reason, variation in temperature which is detected in the temperature detecting region RDT of the IR sensor 29 is reduced compared to a configuration in which it is assumed that the IR sensor 29 is arranged by being inclined to the continuous paper P.

Meanwhile, infrared light of the heater 27 which is reflected by the continuous paper P easily enters the IR sensor 29 compared to a configuration in which it is assumed that the IR sensor 29 is arranged by being inclined to the continuous paper P. However, since the first detection temperature Tir of the IR sensor 29 is corrected based on the heating value DUTY value Hc of the heater 27, it is possible to set the correction temperature Tm to be close to the actual temperature of the continuous paper P which is located in the liquid ejecting region RIL.

(6) According to the liquid ejecting apparatus 11, in an output control, the first detection temperature Tir which is detected by the IR sensor 29 when the ejecting unit 14 is located in the temperature detecting region RDT is not used when controlling the heater 27. For this reason, since the heater 27 is not controlled based on the first detection temperature Tir, which is incorrect, of the IR sensor 29, it is possible to suppress deterioration in accuracy in controlling of the heater 27.

(7) There is a case in which infrared light of the heater 27 which is reflected by the ejecting unit 14 enters the IR sensor 29, also in a case in which the ejecting unit 14 is located in the vicinity of the temperature detecting region RDT. In this point, according to the output control of the embodiment, since the first detection temperature Tir which is detected by the IR sensor 29 when the ejecting unit 14 enters the trigger determination region RJT including the temperature detecting region RDT is not used when controlling the heater 27, it is possible to further suppress deterioration in accuracy in controlling of the heater 27.

(8) The temperature detecting region RDT is located at a center of the trigger determination region RJT in the main scanning direction X. For this reason, a range in which the first detection temperature Tir with a risk that the ejecting unit 14 has an influence on detecting of a temperature of the IR sensor 29 is not used becomes the same in an outward movement and a return movement of the ejecting unit 14 in the main scanning direction X. For this reason, it is possible to suppress deterioration in accuracy in controlling of the heater 27 so as to be the same in the outward movement and the return movement of the ejecting unit 14.

(9) The liquid ejecting apparatus 11 controls the heater 27 based on the first detection temperature Tir which is detected by the IR sensor 29 immediately before the ejecting unit 14 enters the trigger determination region RJT, when the ejecting unit 14 enters the trigger determination region RJT in the output control. For this reason, the heater 27 is controlled using the first detection temperature Tir of the continuous paper P which is located in the liquid ejecting region RIL which reflects a temperature change using the heater 27, instead of the first detection temperature Tir with a risk that the ejecting unit 14 has an influence on detection of a temperature of the IR sensor 29. Accordingly, it is possible to suppress deterioration in accuracy in controlling of the heater 27.

(10) The ejecting unit 14 includes the cover 25 which covers a part which faces the heating unit 15. For this reason, since infrared light of the heater 27 is prevented from entering the liquid ejecting head 23, it is possible to suppress an excessively high temperature of the liquid ejecting head 23. However, since the cover 25 reflects infrared light of the heater 27, there is a case in which the IR sensor 29 detects the temperature of the heater 27 when the ejecting unit 14 is located in the temperature detecting region RDT of the IR sensor 29. In this point, in the liquid ejecting apparatus 11, it is possible to suppress malfunction of the heater 27 since the first detection temperature Tir which is detected by the IR sensor 29 when the ejecting unit 14 enters the temperature detecting region RDT in the output control is not used. Accordingly, it is possible to suppress both an excessively high temperature of the liquid ejecting head 23 and malfunction of the heater 27.

(11) The liquid ejecting apparatus 11 calculates a target temperature of the continuous paper P which is located in the liquid ejecting region RIL for setting a DUTY value of the heater 27, based on the first detection temperature Tir of the IR sensor 29 and the second detection temperature Tth of the nozzle plate thermistor 24 in the output control. For this reason, by setting the DUTY value of the heater 27 in consideration of a temperature of the plurality of nozzles 23*a* of the ejecting unit 14, it is possible to suppress an excessively high temperature of the liquid ejecting head 23 in order to set the DUTY value of the heater 27 to be small, when the temperature of the plurality of nozzles 23*a* increases.

(12) The liquid ejecting apparatus 11 sets a target temperature of the continuous paper P which is located in the liquid ejecting region RIL to be low when the second detection temperature Tth is larger than the temperature threshold value Tk, and the integrated value Di of differences between the second detection temperature Tth and the temperature threshold value Tk increases, in the output control. For this reason, since, the longer the duration of the state in which a temperature of the plurality of nozzles 23*a* is high, the smaller the DUTY value of the heater 27 becomes, the temperature of the plurality of nozzles 23*a* rarely rises, and easily falls.

(13) When a temperature of the continuous paper P which is located in the liquid ejecting region RIL is low, the heat of the continuous paper P has a small influence on the plurality of nozzles 23*a* of the ejecting unit 14, and meanwhile, it is necessary to rapidly raise the temperature of the continuous paper P which is located in the liquid ejecting region RIL up to the reference target temperature Tgk. On the other hand, when the temperature of the continuous paper P which is located in the liquid ejecting region RIL is high, the heat of the continuous paper P has a large influence on the plurality of nozzles 23*a*, and meanwhile, since the temperature of the continuous paper P which is located in the liquid ejecting region RIL is close to the reference target temperature Tgk, or is the reference target temperature Tgk or more, it is not necessary to rapidly raise the temperature of the continuous paper P which is located in the liquid ejecting region RIL.

Based on such facts, the liquid ejecting apparatus 11 controls the heater 27 based on the reference target temperature Tgk when the first detection temperature Tir is the correction target temperature Tgc or less, and controls the heater 27 based on the correction target temperature Tgc when the first detection temperature Tir is higher than the correction target temperature Tgc. For this reason, ink which is ejected onto the continuous paper P which is located in the liquid ejecting region RIL easily dries, and it is possible to control the heater 27 so that a temperature rise of the plurality of nozzles 23*a* is suppressed.

(14) The liquid ejecting apparatus 11 includes the air blowing unit 16 for making a temperature of the continuous paper P, which is located in the liquid ejecting region RIL, uniform. For this reason, since variation in detection of a temperature of the liquid ejecting region RIL in the continuous paper P using the IR sensor 29 is suppressed, it is possible to suppress deterioration in detecting accuracy of the first detection temperature Tir of the IR sensor 29.

The embodiment may be changed to a different embodiment as follows.

The IR sensor 29 in the embodiment is not limited so as to be arranged by confronting a continuous paper P, and may be arranged in a state of being inclined to the continuous paper P on the support member 13.

The IR sensor 29 according to the embodiment may be arranged on the upstream side in a transport path compared to the ejecting unit 14, and may be arranged on the support member 13 side with respect to the continuous paper P.

In the embodiment, as the second temperature detecting unit, another sensor such as an infrared temperature detecting sensor may be used, instead of the nozzle plate thermistor 24 which is formed of a thermo-electric element.

The trigger determination region RJT according to the embodiment is set to a region which is stretched from a center position of the temperature detecting region RDT in the main scanning direction X to both ends in the main scanning direction X by a dimension of the ejecting unit 14 in the main scanning direction X; however, a range in the main scanning direction X may be reduced as long as infrared light of the heater 27 does not have an excessive influence on detecting of a temperature of the IR sensor 29 by being reflected on the ejecting unit 14.

According to the embodiment, the temperature detecting region RDT may be located at a position which is close to the home position, or a position which is close to a side opposite to the home position in the trigger determination region RJT.

In step S2 in the output control according to the embodiment, the determination may be changed to a determination on whether or not the entire ejecting unit 14 enters the trigger determination region RJT.

In step S2 in the output control according to the embodiment, the determination may be changed to a determination on whether or not the ejecting unit 14 enters the temperature detecting region RDT. In this case, the temperature correction unit 37 obtains the first detection temperature Tir which is detected by the IR sensor 29 immediately before the ejecting unit 14 enters the temperature detecting region RDT. According to the configuration, since the heater 27 is controlled by setting a temperature in which a temperature change due to the heater 27 in the liquid ejecting region RIL in a continuous paper P is reflected most as the first detection temperature Tir, instead of the first detection temperature Tir in which the ejecting unit 14 has an influence on detecting of a temperature of the IR sensor 29, it is possible to suppress a deterioration in detecting accuracy in controlling of the heater 27.

In step S3 in the output control according to the embodiment, the first detection temperature Tir before several cycles in a detecting cycle of the IR sensor 29 may be obtained from entering the trigger determination region RJT of the ejecting unit 14, instead of the first detection temperature Tir before entering the trigger determination region RJT of the ejecting unit 14.

In step S3 in the output control according to the embodiment, a substitute temperature which is stored in the memory 36 may be used, instead of the first detection temperature Tir immediately before entering the trigger determination region RJT of the ejecting unit 14. The substitute temperature may be a constant, or may be a mean value of the first detection temperature Tir of several cycles in the detecting cycle of the IR sensor 29.

In step S4 in the output control according to the embodiment, when a relationship between the heating value DUTY value Hc of the heater 27 and a correction coefficient is prescribed, the correction temperature Tm may be calculated by multiplying the first detection temperature Tir by the correction coefficient. The correction coefficient becomes small when the heating value DUTY value Hc of the heater 27 becomes large.

In step S4 in the output control according to the embodiment, the correction value Td may be set to a constant. The correction value Tc may be set to a constant which is different for respective types of a medium.

In step S4 in the output control according to the embodiment, in expression (1) which obtains the correction value Tc, values of the coefficients z1 to z3 are changed according to a type of a medium; however, each value of the coefficients z1 to z3 may be set to a constant value regardless of a type of a medium.

In step S4 in the output control according to the embodiment, the correction value Tc may be obtained based on a calculation table by preparing the calculation table between the heating value DUTY value Hc of the heater 27 and the correction value Tc in advance, instead of calculating the correction value Tc based on the quadratic approximate expression in the expression (1).

In step S5 in the output control according to the embodiment, the correction target temperature Tgc may be calculated by multiplying the reference target temperature Tgk by a correction coefficient, by prescribing a relationship between the heating value DUTY value Hc of the heater 27 and the correction coefficient, instead of calculating the correction target temperature Tgc by subtracting the correction value Td from the reference target temperature Tgk. As the heating value DUTY value Hc of the heater 27 becomes larger, the correction coefficient becomes smaller.

In step S5 in the output control according to the embodiment, the correction value Td may be set to a constant.

In step S5 in the output control according to the embodiment, the correction target temperature Tgc may be set to a constant. In this case, calculations using the expressions (3) and (4) are omitted.

In the output control according to the embodiment, an interruption period of the output control may be set to be the same as a detecting period of the IR sensor 29, or to be shorter than the detecting period of the IR sensor 29. According to the configuration, it is possible for the correction temperature Tm to rapidly follow a target temperature of the continuous paper P which is located in the liquid ejecting region RIL, and for this reason, an accuracy when controlling the heater 27 improves.

The heating unit 15 according to the embodiment may include a plurality of heaters 27. In this case, each heater 27 may be individually controlled. In addition, for example, the correction temperature Tm is calculated as follows. First, the temperature correction unit 37 calculates a heat value of each heater 27 by multiplying each DUTY value of the heater 27 by wattage, and calculates a total heating value of each heater 27 by multiplying a maximum value (100%) of a DUTY value of each heater 27 by wattage. In addition, the temperature correction unit 37 calculates the heating value DUTY value Hc of the plurality of heaters 27 by dividing a total sum of the total heating value of each heater 27 by a total sum of a heating value of each heater 27. In addition, similarly to the above described embodiment, the temperature correction unit 37 calculates the correction value Tc by substituting the heating value DUTY value Hc of the plurality of heaters 27 for the expression (1), and calculates the correction temperature Tm by substituting the correction value Tc for the expression (2).

The cover 25 according to the embodiment may be a resin cover in which coating which reflects infrared light is performed, without being limited to a metal cover. In addition, the cover 25 may be omitted.

According to the embodiment, the liquid ejecting apparatus 11 may be a dot impact printer or a laser printer when the apparatus can perform printing on a medium. In addition, the liquid ejecting apparatus 11 may be a multifunction peripheral, without being limited to a configuration in which only a printing function is included. In addition, the liquid ejecting apparatus 11 may be a line printer, or a page printer without being limited to a serial printer.

A medium is not limited to a continuous paper P, and may be cut paper, a resin film, metal foil, a metal film, a composite film of a resin and metal (laminated film), cloth, non-woven fabric, a ceramic sheet, or the like.

A state of liquid which is ejected as liquid droplets of minute amount from the liquid ejecting head 23 includes a granular shape, a tear shape, and a thread shape leaving a trail. In addition, liquid here may be a material which can be ejected from the liquid ejecting head 23. For example, the liquid may be a material in a state of liquid phase, and includes materials which flow such as a liquid body having high or low viscosity, a sol, a gel, and inorganic solvent, organic solvent, liquid, a liquid resin, other than that. In addition, materials in which particles which are formed of a solid body such as a pigment is melted, diffused, or mixed in a solvent are also included, not only liquid as a state of the material. When the liquid is ink, the ink includes general water-based ink and oil-based ink, and a variety of liquid compositions such as gel ink, hot-melt ink, or the like.

This application claims priority under 35 U.S.C. §119 to Japanese Patent Application No. 2015-013018, filed Jan. 27 2015. The entire disclosure of Japanese Patent Application No. 2015-013018 is hereby incorporated herein by reference.

What is claimed is:

1. A liquid ejecting apparatus comprising:

an ejecting unit which can reciprocate with respect to a medium, and ejects liquid onto the medium;

a heating unit which heats a liquid ejecting region which is a region in which the ejecting unit can eject the liquid to the medium;

a temperature detecting unit which detects a temperature of at least a part of the liquid ejecting region based on infrared light in the liquid ejecting region; and a control unit which controls the heating unit based on a detection temperature of the temperature detecting unit, wherein the control unit controls the heating unit without using the detection temperature which is detected by the temperature detecting unit, when the ejecting unit is located in a temperature detecting region of the temperature detecting unit.

2. The liquid ejecting apparatus according to claim 1, wherein the control unit controls the heating unit without using a detection temperature which is detected by the temperature detecting unit when the ejecting unit is located in a temperature ineffective region which is a region larger than the temperature detecting region, including the entire region of the temperature detecting region in a movement direction of the ejecting unit.

3. The liquid ejecting apparatus according to claim 2, wherein the temperature detecting region is located at a center of the temperature ineffective region in the movement direction of the ejecting unit.

4. The liquid ejecting apparatus according to claim 2, wherein the control unit controls the heating unit based on a detection temperature which is detected by the temperature detecting unit immediately before entering the temperature ineffective region of the ejecting unit.

5. The liquid ejecting apparatus according to claim 1, wherein the control unit controls the heating unit based on a detection temperature which is detected by the temperature detecting unit immediately before entering the temperature detecting region of the ejecting unit.

6. The liquid ejecting apparatus according to claim 1, wherein the heating unit heats the liquid ejecting region using infrared light, wherein the ejecting unit is located on the medium side rather than the heating unit and the temperature detecting unit, and wherein a portion of the ejecting unit which faces the heating unit is covered with a cover which reflects the infrared light.

* * * * *